United States Patent [19]

Bartis

[11] Patent Number: 4,815,621

[45] Date of Patent: Mar. 28, 1989

[54] ABOVE-GROUND PORTABLE STORAGE TANK

[76] Inventor: Peter A. Bartis, 105 East View Ter., Meriden, Conn. 06450

[21] Appl. No.: 135,058

[22] Filed: Dec. 18, 1987

[51] Int. Cl.[4] ..... B65D 90/00

[52] U.S. Cl. ..... 220/1 B; 220/85 R; 220/202; 220/203; 220/208

[58] Field of Search ..... 220/1 B, 85 R, 85 S, 220/202, 203, 208, 469, 5 A, 18

[56] References Cited

U.S. PATENT DOCUMENTS

| | | | |
|---|---|---|---|
| 1,494,818 | 5/1924 | Shean | 220/5 A |
| 1,716,950 | 6/1929 | Day | 220/85 B |
| 2,446,844 | 8/1948 | Molaver | 220/85 R |
| 2,580,057 | 12/1951 | Wilhelm | 220/85 R |
| 2,955,723 | 10/1960 | McGrath | 220/20.5 |
| 3,008,483 | 11/1961 | Beckwith | 220/208 |
| 3,791,164 | 2/1974 | Lauerman | 220/18 |
| 3,848,765 | 11/1974 | Dürkop | 220/18 |
| 3,989,155 | 11/1976 | Conklin | 220/85 R |
| 4,114,783 | 9/1978 | Wempe et al. | 220/85 S |
| 4,254,888 | 3/1981 | Chandler | 220/210 |
| 4,456,141 | 6/1984 | Pamment | 220/335 |
| 4,514,931 | 5/1985 | Beck et al. | 220/208 |
| 4,580,607 | 4/1986 | Cantele | 220/DIG. 6 |
| 4,629,087 | 12/1986 | Lenz | 220/5 A |
| 4,638,920 | 1/1987 | Goodhues, Jr. | 220/85.5 |
| 4,696,409 | 9/1987 | Vize | 220/208 |

FOREIGN PATENT DOCUMENTS

| | | | |
|---|---|---|---|
| 228717 | 12/1962 | Austria | 220/1 B |

*Primary Examiner*—David T. Fidei

*Attorney, Agent, or Firm*—Bachman & LaPointe

[57] ABSTRACT

The present invention relates to an above-ground double wall portable container for storing liquid products. The container has a primary tank for holding liquid, a secondary tank substantially surrounding the primary tank for containing the stored liquid in the event of a failure in the primary tank, a removable cover for closing the secondary tank and a sealable inlet box through which liquid is introduced into and withdrawn from the primary tank. The inlet box houses a screen for removing debris from liquid being introduced into the tank, a suction port for withdrawing liquid from the tank and integral vents for permitting vapors to escape to the atmosphere.

23 Claims, 3 Drawing Sheets

ABOVE-GROUND PORTABLE STORAGE TANK

BACKGROUND OF THE INVENTION

The present invention relates to an above-ground, portable, double-walled container for storing waste liquids.

Underground storage tanks are currently used to store petroleum products such as gasoline, crude oil and heating oil as well as chemicals listed on the Environmental Protection Agency's hazardous substance list. Contamination of ground water from these underground storage tanks has become a serious problem. Antiquated steel tanks lacking corrosion protection, leak detection devices and spill prevention devices are a prime source of this form of pollution.

The U.S. Environmental Protection Agency has proposed new regulations to prevent contamination from such underground storage tanks. These regulations require that all newly installed underground tanks be protected from corrosion. A steel tank must be cathodically protected and coated with corrosion-resistant materials. Other tanks must be made totally of a non-corrodible material such as fiberglass or of a composite of steel and non-corrodible material. The materials in the tank must also be electrolytically compatible with the stored product. All tanks must also have leak-detection systems that provide monitoring at least every 30 days and devices that prevent spills and overfills. Additionally, tanks used to store hazardous chemicals must have dual or secondary containment tanks and leak detection systems installed between the inner and outer tanks.

Owners of underground tanks have begun to seek other methods of storage because of these and other onerous environmental regulations. These other methods have included the smaller and temporary above-ground use of 55 gallon drums and 275 gallon basement fuel tanks. Unfortunately, the use of these drums and tanks has not been without problems. Due to the absence of adequate corrosion protection, these drums and tanks have developed serious leaks. Containment dikes have been built around these above-ground tanks to collect the leaked contaminated liquids. These dikes, however, have caused other problems. For example, the dikes often become filled with rain water. Any additional leakage from the tanks simply overflows the sides. If the drums or tanks are empty, they often float or capsize in the filled dikes. Drains have been installed to allow collected water to be withdrawn, but if the drain plugs are inadvertently let loose or not replaced, they serve no useful purpose. In most cases, the dikes create more problems than they solve. There is still a need for suitable alternative above-ground waste storage tanks.

Accordingly, it is an object of the present invention to provide an above-ground storage tank which is both practical and convenient.

It is a further object of the present invention to provide a storage tank as above which complies with and in most cases exceeds environmental regulations.

It is still a further object of the present invention to provide a storage tank as above which is portable.

These and other objects and advantges will become more apparent from the following description and drawings in which like reference numerals depict like elements.

SUMMARY OF THE INVENTION

The present invention relates to an above-ground portable container for storing liquids such as new and waste petroleum products including motor vehicle and crankcase drain oil, transmission fluid, hydraulic oil, paraffin or synthetic base lubricating oil, No. 2 fuel oil, No. 4 fuel oil and cutting oil, as well as other products. The container has a primary tank for holding liquid, a secondary tank substantially surrounding the primary tank for containing the stored liquid in the event that the primary tank fails, a removable cover closing the secondary tank and a tamper proof, multi-purpose pouring inlet box through which liquid can be introduced into and withdrawn from the primary tank. The inlet box includes a screen for removing debris from liquid as it is being introduced, at least one aperture for allowing vapors to vent from the interior of the tanks to the atmosphere, and a conduit for withdrawing liquid from the primary tank. The conduit has a first port to which a means for applying suction can be attached, a closed end for protecting the bottom of the primary tank, and a plurality of ports adjacent the closed end through which liquid can enter the conduit.

The container in accordance with the present invention also includes an indicator for indicating the level of the liquid in the primary tank, a leak indicator mounted within a sidewall of the secondary or containment tank and/or an emergency vent valve. The container is further characterized by the presence of supports mounted to the lower surface of the secondary tank having means for receiving forklift tines to permit movement of the container from one place to another.

DETAILED DESCRIPTION

Figure 1:
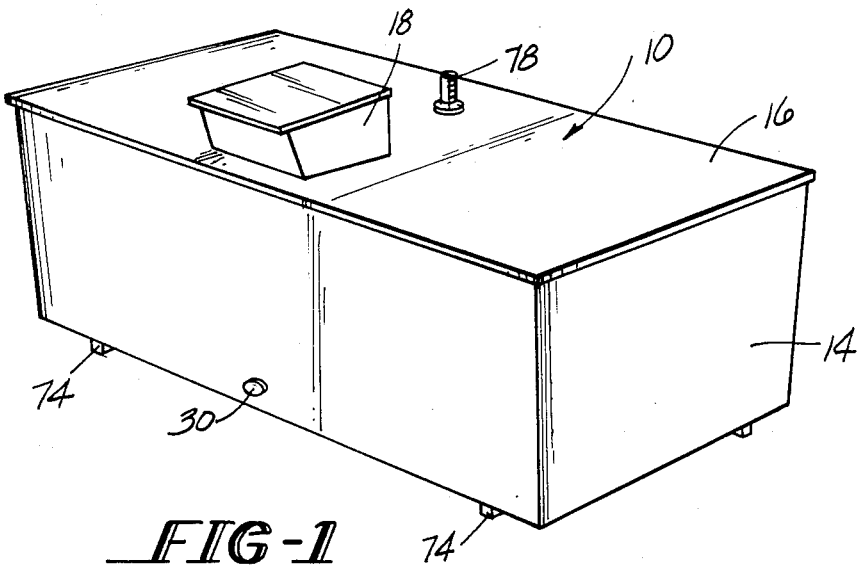
FIG. 1 is a perspective view of a storage tank in accordance with the present invention.
Figure 2:
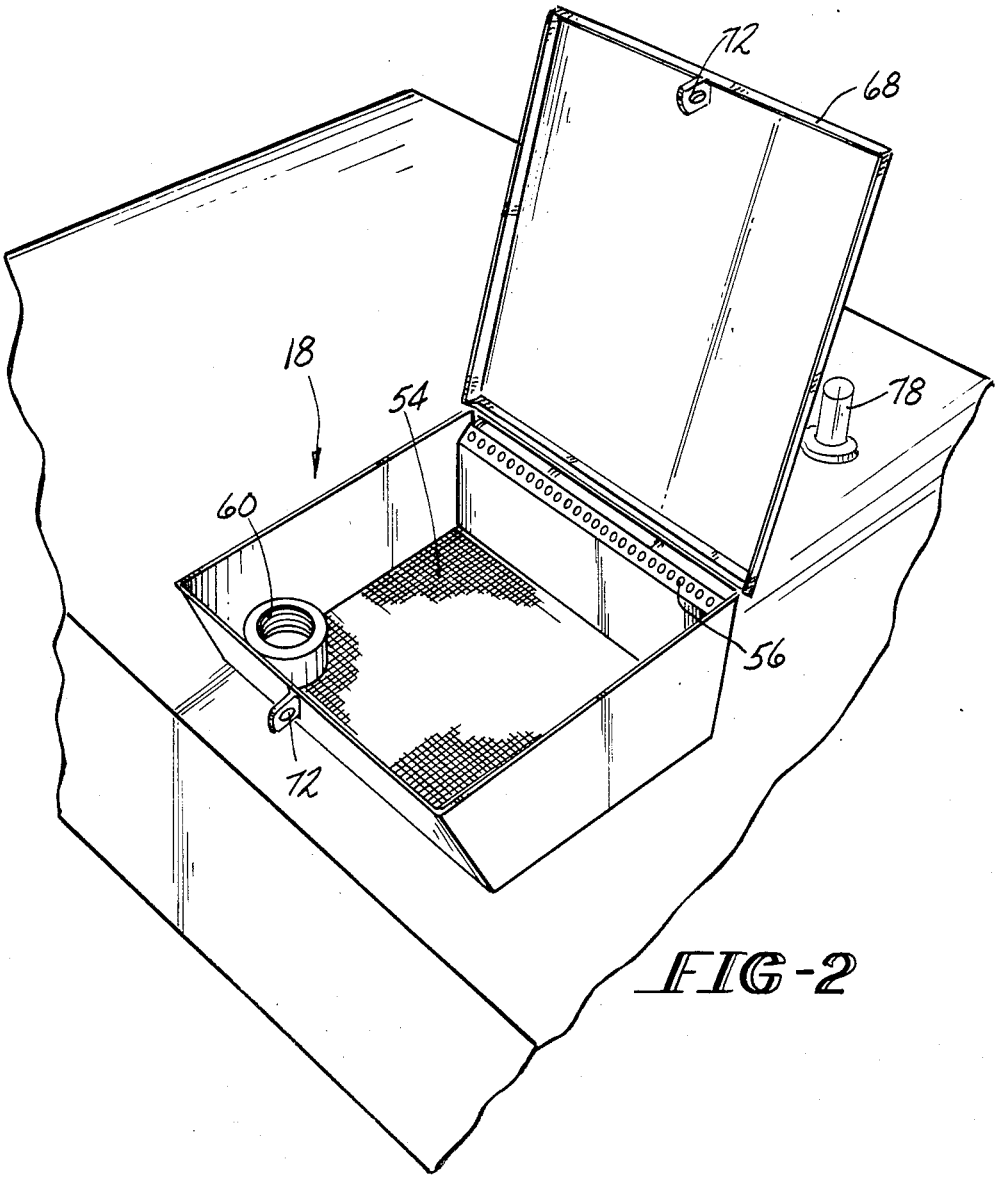
FIG. 2 is a perspective view of the inlet box attached to the top of the storage tank cover.
Figure 3:
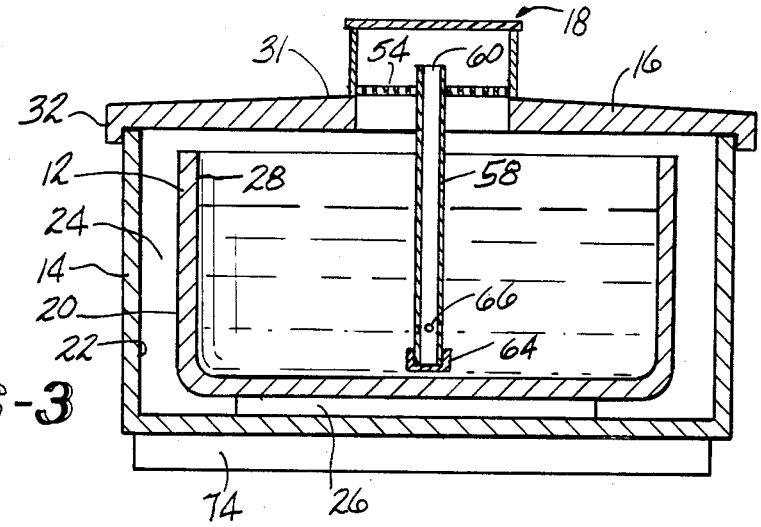
FIG. 3 is an end view of the storage tank of FIG. 1 in cross section.
Figure 4:
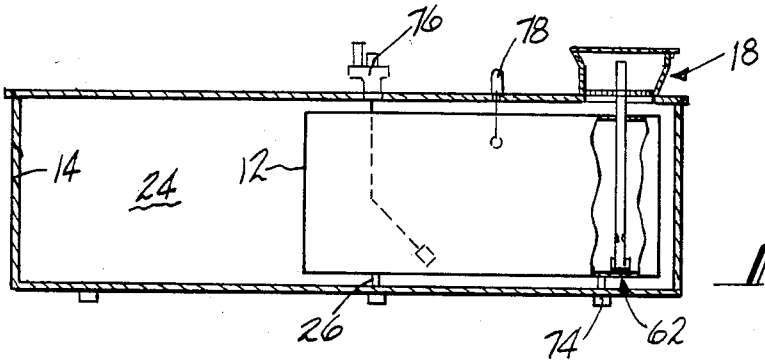
FIG. 4 is a side view of the storage tank of FIG. 1 in cross section.

Referring now to the Figures, the self-contained, packaged, above-ground, portable double-wall liquid storage container 10 of the present invention includes an inner primary liquid storage tank 12, an outer containment tank 14, a removable cover 16 and a multi-purpose inlet box 18. As best shown in FIGS. 3 and 4, the inner tank 12 is substantially surrounded by the outer tank 14. The exterior surfaces 20 of the tank 12 are spaced from the interior surfaces 22 of the tank 14 so as to create a secondary liquid containment space 24. The tank 12 may be supported within the tank 14 in any desired manner. For example, it may be mounted on supports 26.

The inner storage tank 12 may comprise any suitable tank known in the art having any desired shape. For example, it could be an open top, vat type tank such as that shown in FIG. 3 constructed from steel, stainless steel, polyethylene, composites of the foregoing materials, or any other suitable material. When an open tank is utilized, the interior and exterior surfaces 28 and 20, respectively, are finished with suitable corrosion resistant coatings such as textured lacquer or alkyed enamel. Alternatively, the tank 12 could be a closed type tank constructed from steel, stainless steel, or any other suitable material. When a closed tank is used, only the exterior surfaces 20 are finished with a corrosion resistant coating.

The outer containment tank 14 may also comprise any suitable open top, vat type tank known in the art having any desired shape and formed from any suitable material. For example, the tank 14 could be rectangular in shape and could be formed from welded steel, stainless steel, or molded polyethylene resin. To help protect a metallic tank from corrosion, all surfaces of the metallic tank are smoothed, cleaned, primed and finished with a corrosion resistant coating. A leak indicator 30 such as a cavity sight glass visual leak indicator is mounted in one of the walls of tank 14 to allow periodic leak detection inspections.

The removable cover 16 is provided to seal the open containment tank 14 and the inner tank 12 when it too is open. Preferably, the cover 16 is formed from steel or stainless steel whose surfaces have been finished with a corrosion resistant coating. Alternatively, the cover 16 may be formed from molded polyethylene resin. The cover 16 is characterized by a slightly domed central portion 31 and a turned down drip edge 32. The cover 16 may be secured to the tank 14 and/or the tank 12 in any manner known in the art.

Figure 5:
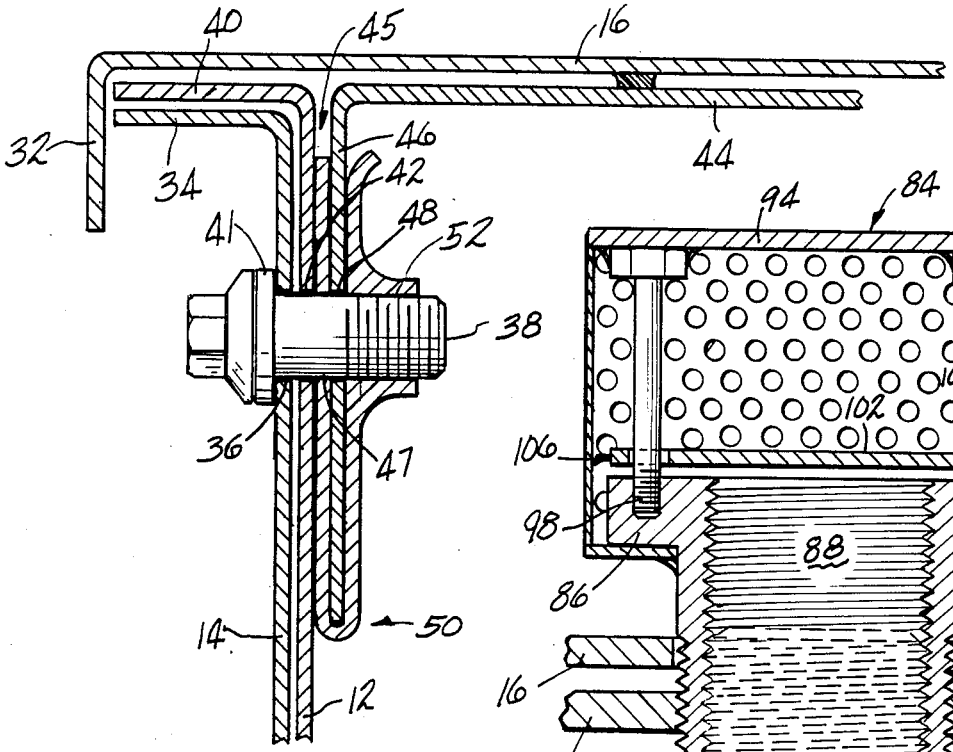
FIG. 5 is a partial cross-sectional view of the storage tank of FIG. 1 illustrating a means for joining the tank components.
Figure 7:
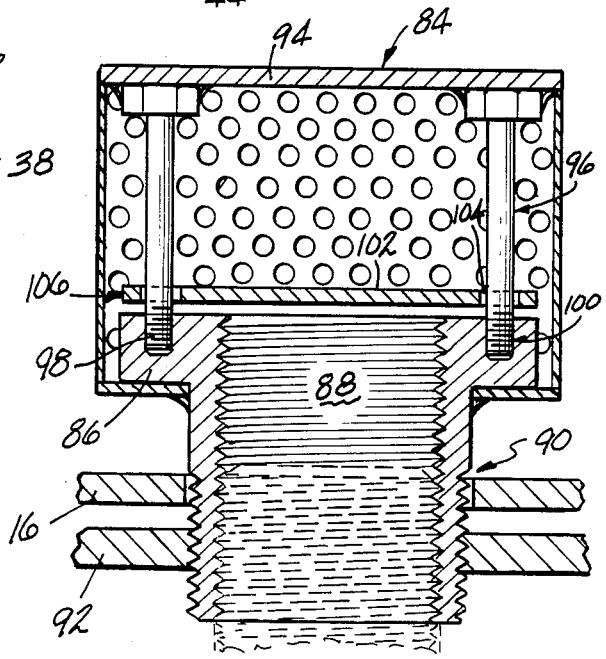
FIG. 7 illustrates an emergency vent valve in partial cross section to be used with the storage tank of the present invention.

One approach for securing a metallic cover 16 to the tanks 12 and 14 is illustrated in FIG. 5. In this approach, the tanks 12 and 14 are each provided with an external lip 34 and 40, respectively, about its periphery. The lips 34 and 40 may each be formed by metal flanges welded to the outer surface of the respective tank. The tanks 12 and 14 are also provided with a plurality of spaced apart, aligned apertures 36 and 42 about their respective peripheries for receiving suitable fasteners such as threaded bolts 38. When assembled, the apertures 36 and 42 are placed into the desired alignment by resting the lip 40 on the lip 34.

To secure the cover 16 to the tanks, a right-angle metal flange 44 is welded to the underside of the cover. The flange may have a shape which corresponds to the shape of tanks 12 and 14. The flange 44 is positioned on the cover so that a gap 45 is provided between the inner surface 28 of tank 12 and the leg 46 of the flange when the cover is in the closed position. The gap 45 is provided to permit the insertion of a plurality of securing clips 50 about the leg 46 of the flange. Each securing clip 50 comprises a substantially U-shaped member having a threaded bore 52 to be aligned with apertures 36 and 42 as well as with aperture 47 in the clip 50 and aperture 48 in the leg 46. To secure the cover in position, a threaded bolt is inserted through apertures 36, 42, 47 and 48 and into threaded engagement with the bore 52.

A rectangularly shaped inlet box 18 is mounted to the cover 16. Liquid such as used motor oil to be stored in the container 10 is introduced into the tank 12 through the inlet box 18. Similarly, liquid is withdrawn from the tank 12 via a conduit 58 which extends from the tank 12 to the inlet box 18.

Figure 6:
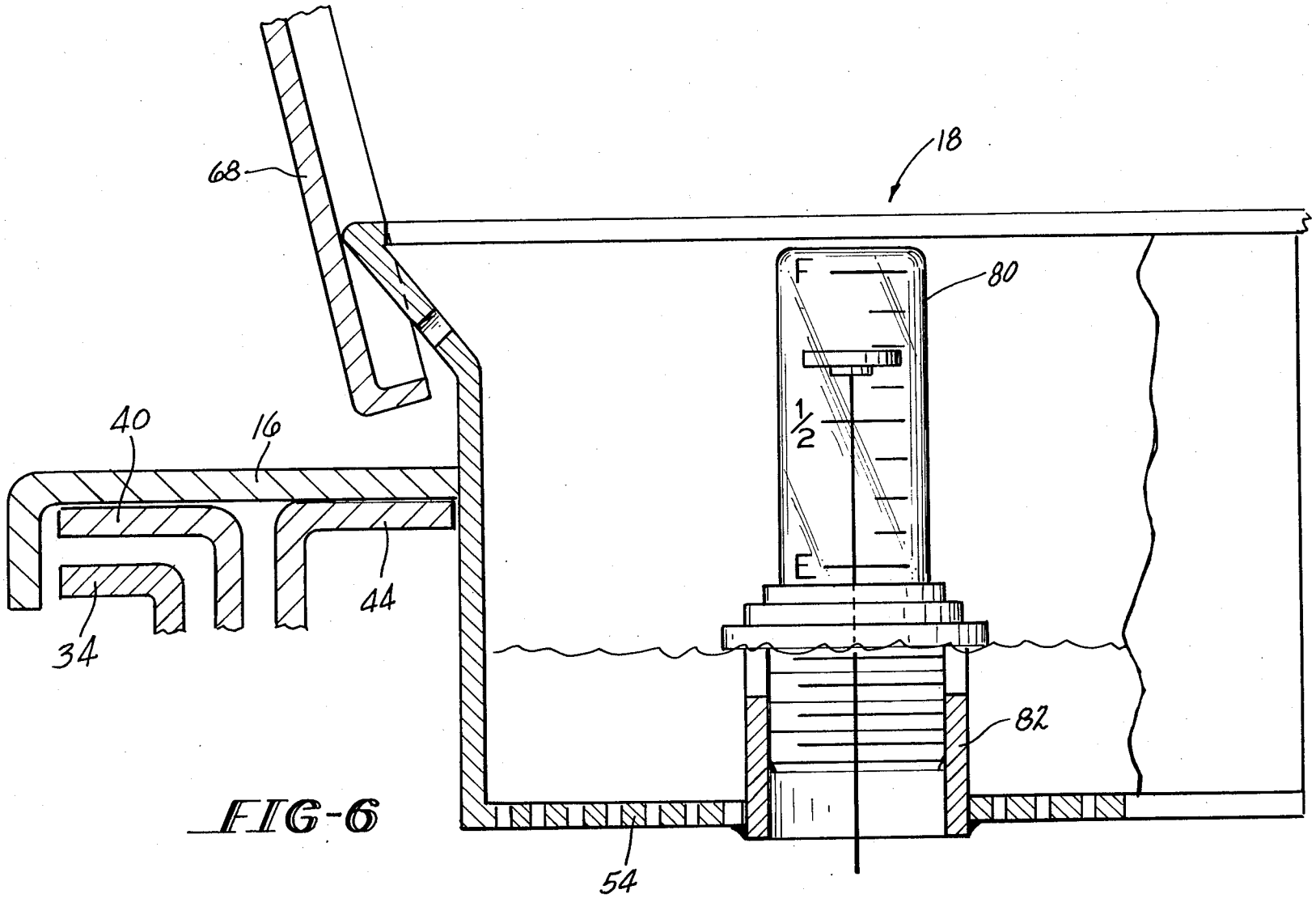
FIG. 6 is a partial cross-sectional view of an alternative embodiment of the storage tank.

The inlet box 18 may be mounted to the cover 16 in any desired manner. For example, the inlet box 18 may be welded or screwed to the cover 16. Alternatively, it may be remotely mounted to the cover 16. Still further, it could be recessed into the cover 16 as shown in FIG. 6.

In a preferred embodiment, the box 18 houses a screen 54 for removing debris from liquid being introduced into the container 10 and a plurality of apertures 56 for permitting vapors within the tank 12 and/or 14 to vent to the atmosphere. The conduit 58 which extends from the tank 12 to the box 18 preferably passes through a suitable opening in the debris screen 54.

The conduit 58 in the box 18 is provided with a threaded port 60 to enable the conduit to be connected to a suitable suction device not shown for withdrawing liquid from the tank 12. The end 62 of the conduit opposed to the port 60 is closed by a cap 64 to prevent damage to the interior of the tank 12. The cap 64 may be threadably mounted to the conduit 58. Liquid to be withdrawn from the tank 12 flows into the conduit 58 via radial inlet ports 66 located about the periphery of conduit 58 adjacent cap 64. If desired, the ports 66 could form part of the cap structure.

To permit the inlet box 18 to be sealed and locked and thereby prevent unauthorized use and vandalism, an oversize lid 68 is hinged to the back wall of the box. The rotation of the lid 68 may be limited by a suitable stop not shown. The lid 68 and the front wall of the box each have suitable means such as eyes 72 for receiving a lock 70.

The container 10 is mounted on supports 74 to permit easy movement by a pallet truck or forklift and to space the bottom of the container from the ground. The supports 74 may be formed either by C-shaped channels or open ended rectangular tubing fastened to the bottom of the outer tank 14. If an open ended channel or tubing is used for the supports 74, it should be capable of receiving a forklift tine.

If desired, the container 10 may be provided with a combination vent/level gauge 76 to indicate the level of liquid in tank 12 and/or overflow indicator 78. The gauge 76 and indicator 78 are desirable because they assist in preventing overflows and spills of the liquid in tank 12. The vent portion of the gauge 76 is useful in providing additional means for venting vapors in the tanks to the atmosphere.

In lieu of the combination vent/level gauge 76, a level gauge 80 may be positioned and concealed within the inlet box 18. The gauge 80 may comprise any suitable gauge known in the art and may be secured to the bottom of the inlet box in any desired manner such as by a N.P.T. half-coupling 82 welded to the bottom and/or screen 54. Such an arrangement is desirable if one wants to conceal the level gauge.

The container 10 may also be provided with an emergency valve 84 for venting any overpressure within the tanks 12 and 14. The valve 84 includes a base member formed by a circular bushing 86 having a central passageway 88 through which any overpressure and/or fumes and vapors may vent and a threaded mounting portion 90 to be engaged by a flange 92 which is welded or otherwise fastened to the cover 16. The mounting portion 90 may if desired be internally threaded to receive a threaded pipe or conduit which extends into one or more of the tanks. The valve 84 further includes a circular cover plate 94 to which a plurality of bolts, ideally three bolts, are attached for spacing the plate 94 a desired distance from the bushing 86. The bolts 96 are spaced about the periphery of the plate and are preferably welded thereto. Each bolt 96 has a threaded portion 98 which is received in a respective threaded bore 100 in the bushing 86. The cover plate 94, the bushing 86 and the bolts 96 define a housing for the valve 84.

A circular lift plate 102 is provided to open and close the passageway 88. The lift plate 102 has a diameter substantially equal to the diameter of the circular bushing and a plurality of apertures 104 about its periphery through which the bolts 96 pass. The apertures 104 are arranged to align with the bores 100. During operation, the apertures 104 permit the plate 102 to slide along the bolts 96 which function as guides for the lift plate. Thus, in an emergency situation, an overpressure in the tank(s) will cause the lift plate to rise and open the passageway 88 to the atmosphere. The overpressure and/or any fumes or vapors are then vented through the passageway 88 to the atmosphere. After the overpressure is released, the guide plate drops and resumes the passageway closed position.

A screen 106 is provided about the periphery of the valve to permit release of the overpressure and any vapors or fumes and to prevent the entry of any debris or the intentional or inadverent insertion of a foreign object which would interfere with operation of the lift plate and the valve. The screen 106 also prevents adverse weather elements such as ice from interfering with operation of the lift plate and the valve. The screen 106 may be attached to the plate 94 and the bushing 86 in any desired manner.

The inner tank 12 of container 10 may have any desired capacity. Typical storage capacities are in the range of from about 90 to about 475 U.S. gallons. To provide adequate containment capacity, the outer tank 14 should have a capacity which is from about 1% to about 110% greater than the volumetric capacity of the inner tank 12.

To prevent liquid from leaking out of the container 10, appropriate sealants such as silicone and suitable gasket materials such as Buna-N may be used between the cover 16 and the tanks 12 and/or 14.

While it is preferred to use visual leak indicators, other types or leak indicators such as aural alarms may be used if desired.

As can be seen from the foregoing discussion, the problem of safely storing liquid waste economically and efficiently is solved by the above-ground, double wall portable tank of the present invention. The hassle of inspections, leak detectors, and certification of underground storage tank has now been completely eliminated. In addition, the present invention overcomes the problems of unauthorized use, vandalism, and ease of use. The inlet box of the present invention may be placed at waist level thereby eliminating reaching or climbing up makeshift stairs.

It is apparent that there has been provided in accordance with this invention an above-ground portable storage tank which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

What is claimed is:

1. An above-ground portable container for storing liquids which comprises a primary tank for holding said liquid to be stored, a secondary tank substantially surrounding said primary tank for containing said stored liquid in the event of the failure of said primary tank, said secondary tank being spaced from said primary tank, a cover for closing said secondary tank, an inlet box attached to said cover through which liquid is introduced into and withdrawn from said primary tank, a conduit extending between said inlet box and said primary tank, said conduit having a first port to which a means for applying suction can be attached, a closed end for protecting an interior surface of said primary tank, and a plurality of inlet ports adjacent said closed end through which said stored liquid can enter said conduit, and said first port being located within said inlet box.

2. An above-ground portable container for storing liquids which comprises a primary tank for holding said liquid to be stored, a secondary tank substantially surrounding said primary tank for containing said stored liquid in the event of the failure of said primary tank, said secondary tank being spaced from said primary tank, a cover for closing said secondary tank, an inlet box attached to said cover through which liquid is introduced into and withdrawn from said primary tank, and said inlet box having at least one aperture for permitting vapors within said tank to vent to the atmosphere.

3. A container in accordance with claim 2 wherein said inlet box has a screen for removing debris from said liquid as it is being introduced into said tank.

4. A container in accordance with claim 2 wherein said inlet box has a cover and means for locking said cover in a closed position to prevent unauthorized use and vandalism.

5. A container in accordance with claim 2 wherein said inlet box is recessed into said cover.

6. A container in accordance with claim 2 which further comprises means for securing said tanks together.

7. A above-ground portable container for storing liquids which comprises a primary tank for holding said liquid to be stored, a secondary tank substantially surrounding said primary tank for containing said stored liquid in the event of the failure of said primary tank, said secondary tank being spaced from said primary tank, a cover for closing said secondary tank, an inlet box attached to said cover through which liquid is introduced into and withdrawn from said primary tank, means for securing said tanks together, each of said tanks comprising an open top tank, said secondary tank having a first flange adjacent said open top and at least one aperture in a sidewall, said primary tank having a second flange which rests upon the upper surface of said first flange and at least one aperture in a sidewall which can be aligned with said at least one aperture in said secondary tank sidewall, said cover having an angled flange having an exterior surface spaced from an interior surface of said primary tank when said cover is in said closed position, said angled flange having at least one aperture which can be aligned with said at least one aperture in each of said tank sidewalls, and said securing means comprising a clip-like retaining device having a first leg which can be inserted into said space between said exterior surface of said angled flange and said interior surface of said primary tank and a second leg with a threaded plug attached thereto and a threaded fastening means whose threads engage said threads in said plug.

8. A container in accordance with claim 2 which further comprises means for indicating the level of said liquid within said primary tank.

9. A container in accordance with claim 2 which further comprises a leak indicator mounted within a sidewall of said secondary tank.

10. A container in accordance with claim 2 which further comprises means for venting the interior of said tanks mounted to said cover.

11. A container in accordance with claim 2 which further comprises supports mounted to a lower surface of said secondary container to space said lower surface from the ground.

12. A container in accordance with claim 11 wherein said supports have means for receiving the tines of a forklift to permit movement of said container.

13. A container in accordance with claim 2 wherein said cover has a slightly domed central portion.

14. A container in accordance with claim 2 wherein each of said tanks is formed from steel and has a corrosion resistant coating applied to at least one surface.

15. A container in accordance with claim 2 wherein said secondary tank has a volume which is from about 1% to about 110% greater than the volumetric capacity of the primary tank.

16. A container in accordance with claim 2 which further comprises said cover being removable and means for securing said cover to said secondary tank.

17. A container in accordance with claim 10 wherein said venting means comprises:

a base member having a fluid passageway;

a cover plate spaced from said base member;

a valve member for closing said passageway; and means for guiding movement of said valve member between a closed position and an open position, said guiding means being fastened to said cover plate and serving to space said cover plate from said base member and to define a housing with said cover plate and said base member.

18. A container in accordance with claim 17 which further comprises:

said base member being formed by a bushing having a central fluid passageway, a plurality of threaded bores spaced about its periphery, and a threaded mounting portion;

a flange connected to said container cover for engaging said threaded mounting portion;

said valve member being formed by a lift plate covering said fluid passageway having a plurality of apertures spaced about its periphery, said apertures being aligned with said bushing bores;

said guiding means being formed by a plurality of bolts spaced about the periphery of the cover plate;

said bolts passing through said apertures in said lift plate and having threads for engaging said bores in said bushing; and a screen attached to said bushing and said cover plate, said screen preventing adverse weather elements, debris and foreign objects from interfering with operation of the lift plate and the venting means, whereby an overpressure within said container causes said lift plate to rise and open said passageway to the atmosphere thereby permitting release of said overpressure.

19. An emergency vent valve for releasing an overpressure in a container which comprises:

a base member having a fluid passageway;

a cover plate spaced from said base member;

a valve member for closing said passageway;

means for guiding movement of said valve member between a closed position and an open position;

said guiding means being fastened to said cover plate and serving to space said cover plate from said base member and to define a housing with said cover plate and said base member.

20. A vent valve in accordance with claim 19 which further comprises:

means for preventing adverse weather elements, debris and foreign objects from interfering with the operation of said valve member.

21. A vent valve in accordance with claim 20 wherein said preventing means comprises a screen attached to said base member and said cover plate.

22. A vent valve in accordance with claim 19 wherein:

said base member comprises a bushing having a plurality of threaded bores spaced about its periphery, said valve member comprises a lift plate having a plurality of apertures spaced about its periphery, said apertures being aligned with said bushing bores; and said guiding means comprises a plurality of bolts fastened to said cover plate, said bolts passing through said apertures in said lift plate and having threads for mating with said bushing bores, whereby said overpressure causes said lift plate to rise and moving along said bolts to said open position, thereby permitting release of said overpressure through said passageway.

23. A vent valve in accordance with claim 22 which further comprises said bushing having a mounting portion for fastening said vent valve to a portion of said container.

* * * * *